US011242610B2

(12) United States Patent
Yamanishi et al.

(10) Patent No.: US 11,242,610 B2
(45) Date of Patent: Feb. 8, 2022

(54) PLATING METHOD, BUBBLE EJECTION MEMBER, PLATING APPARATUS, AND DEVICE

(71) Applicant: KYUSHU UNIVERSITY, NATIONAL UNIVERSITY CORPORATION, Fukuoka (JP)

(72) Inventors: Yoko Yamanishi, Fukuoka (JP); Yudai Fukuyama, Fukuoka (JP); Keita Ichikawa, Fukuoka (JP)

(73) Assignee: KYUSHU UNIVERSITY, NATIONAL UNIVERSITY CORPORATION, Fukuoka (JP)

( * ) Notice: Subject to any disclaimer, the term of this patent is extended or adjusted under 35 U.S.C. 154(b) by 0 days.

(21) Appl. No.: 16/757,109

(22) PCT Filed: Oct. 17, 2018

(86) PCT No.: PCT/JP2018/038580
§ 371 (c)(1),
(2) Date: Apr. 17, 2020

(87) PCT Pub. No.: WO2019/078229
PCT Pub. Date: Apr. 25, 2019

(65) Prior Publication Data

US 2020/0240031 A1 Jul. 30, 2020

(30) Foreign Application Priority Data

Oct. 19, 2017 (JP) ..... JP2017-202994

(51) Int. Cl.
*C23C 18/16* (2006.01)
*B05B 17/06* (2006.01)
*C25D 5/00* (2006.01)

(52) U.S. Cl.
CPC ..... *C25D 5/003* (2013.01); *B05B 17/0607* (2013.01); *C23C 18/1669* (2013.01); *C23C 18/1671* (2013.01)

(58) Field of Classification Search
CPC ..... B05B 17/0607; C23C 18/1671; C23C 18/1669; C25D 5/003; C25D 5/026;
(Continued)

(56) References Cited

U.S. PATENT DOCUMENTS 8,261,437 B2 9/2012 Yanagimoto et al.
10,697,079 B2 6/2020 Yamamoto et al.
(Continued)

FOREIGN PATENT DOCUMENTS

CN 104271059 A 1/2015
EP 3040453 A1 7/2016
(Continued)

OTHER PUBLICATIONS

English translation of Written Opinion issued in corresponding International Application No. PCT/JP2018/038580, dated Dec. 25, 2018.
(Continued)

*Primary Examiner* — Dah-Wei D. Yuan
*Assistant Examiner* — Nga Leung V Law
(74) *Attorney, Agent, or Firm* — McDermott Will & Emery LLP

(57) ABSTRACT

A method that can plate a predetermined position on various plating targets without implementing a pretreatment thereon is provided. A plating method is performed on a plating target using a plating solution, and the plating method includes at least a bubble ejection step of ejecting a bubble generated by a bubble ejection member to a plating solution. The bubble ejection member includes an electrode formed of a conductive material and an insulating material covering at
(Continued)

least a part of the electrode, at least a part of the insulating material forms a bubble ejection port, and an air gap surrounded by the insulating material is formed between at least a part of the electrode and the bubble ejection port.

16 Claims, 11 Drawing Sheets

(58) Field of Classification Search
CPC ... C25D 7/12; C25D 5/56; C25D 5/08; C25D 3/38; C25D 3/12
See application file for complete search history.

(56) References Cited

U.S. PATENT DOCUMENTS

| | | | | |
|---|---|---|---|---|
| 10,716,610 | B2 | 7/2020 | Yamanishi et al. | |
| 2016/0208405 | A1 | 7/2016 | Yamanishi et al. | |
| 2018/0105945 | A1* | 4/2018 | Konopka | C25D 3/22 |
| 2018/0178461 | A1* | 6/2018 | Kim | C25D 21/02 |
| 2019/0003069 | A1* | 1/2019 | Yamamoto | C25D 17/12 |

FOREIGN PATENT DOCUMENTS

| | | | | |
|---|---|---|---|---|
| EP | 3202884 | A1 | 8/2017 | |
| JP | H0296729 | U * | 8/1990 | |
| JP | H02096729 | U | 8/1990 | |
| JP | 2009065207 | A | 3/2009 | |
| JP | 4697156 | B2 | 6/2011 | |
| JP | 5640667 | B2 | 12/2014 | |
| JP | 2015048268 | A | 3/2015 | |
| WO | 2017/110765 | A1 | 6/2017 | |
| WO | WO-2017110765 | A1 * | 6/2017 | C25D 7/12 |

OTHER PUBLICATIONS

Extended European Search Report dated Oct. 27, 2020 in European Application No. 18868306.4.

Richmonds et al, "Plasma-liquid electrochemistry: Rapid synthesis of colloidal metal nanoparticles by microplasma reduction of aqueous cations", Applied Physics Letters, AIP Publishing LLC, vol. 93, No. 13, pp. 131501-1-131501-3, Oct. 1, 2008.

Notice of first review opinion issued in corresponding CN Application No. 201880067374.1, dated Oct. 22, 2021 w/Machine English Translation.

* cited by examiner

PLATING METHOD, BUBBLE EJECTION MEMBER, PLATING APPARATUS, AND DEVICE

CROSS-REFERENCE OF RELATED APPLICATION

This application is the U.S. National Phase under 35 U.S.C. § 371 of International Patent Application No. PCT/W2018/038580, filed on Oct. 17, 2018, which in turn claims the benefit of Japanese Application No. 2017-202994, filed on Oct. 19, 2017, the entire disclosures of which Applications are incorporated by reference herein.

TECHNICAL FIELD

The present disclosure relates to a plating method, a bubble ejection member, a plating apparatus, and a device.

BACKGROUND ART

Plating is a generic term of a technology of depositing a metal on a surface of a solid such as a metal or a nonmetal. As plating methods, electroplating, non-electrolytic plating (catalyst plating), vapor plating, and the like are known. Further, plating may provide various effects of, for example, giving corrosion resistance to protect a material from rust, giving decorativeness to have beautiful appearance, giving functionality such as an electric characteristic, a mechanical characteristic, a physical characteristic, a chemical characteristic, an optical characteristic, or a thermal characteristic, or the like.

As an example method of giving the electric characteristic described above, a method of producing a circuit board by using plating is known. As a specific example method of producing a circuit board, a method of forming a palladium film on recesses in a resin layer in which a recessed pattern is formed and then forming a circuit on the palladium film with non-electrolytic plating copper (see Patent Literature 1) and a method of forming a conductive material layer in a recess of a resin mold article in which recesses are formed and then providing metal wirings on the conductive material layer by using plating to produce a circuit board (see Patent Literature 2) are known, for example.

CITATION LIST

Patent Literature

Patent Literature 1: Japanese Patent No. 5640667
Patent Literature 2: Japanese Patent No. 4697156

SUMMARY OF INVENTION

Technical Problem

Among the conventional plating methods, the electroplating method is required to dip an anode and a cathode in a plating solution and cause current to flow therebetween. Thus, it is not possible to plate a nonconductive member such as a silicon, a rubber, or a resin, and this causes a problem of a plating target being limited to conductive members such as a metal substrate.

On the other hand, as disclosed in Patent Literatures 1 and 2 described above, a non-electrolytic plating method can be used to plate a nonconductive material such as a silicon, a rubber, or a resin by forming a catalyst (the palladium film 14 in Patent Literature 1, and the conductive material layer 13 in Patent Literature 2) in advance on a plating target. As described above, however, when plating a nonconductive material, it is necessary to form a catalyst in advance only on an intended plating place. Therefore, a substrate surface treatment is required in order to form a catalyst at a predetermined position before performing non-electrolytic plating, and this causes a problem of a complexed manufacturing process.

Further, a vapor plating method is a method of plating a target with vapored metal vapor, metal ions ionized by application of a high voltage, or halogenated vapor of a metal inside an airtight container. Thus, there is a problem of an increase in the size of a facility and an increased in cost. Further, to plate only a predetermined position, a substrate surface treatment is required, and this causes a problem of a complexed manufacturing process.

Further, both the electroplating method and the non-electrolytic plating method are required to dip a plating target in a plating solution. Thus, there is a problem of use of a large amount of a plating solution in plating. Currently, there is no method of plating a desired position on various plating targets without implementing a pretreatment thereon.

The disclosure in the present specification has been made in order to solve the problems described above, and according to a thorough study, it has been newly found that, by (1) using an electrode formed of a conductive material and a bubble ejection member including an insulating material covering at least a part of the electrode and (2) ejecting bubbles generated by the bubble ejection member to the plating solution, it is possible to convert metal ions in a plating solution into a metal and that, by (3) attaching the metal generated from the metal ions to a plating target or (4) ejecting bubbles into the plating solution containing metal nanoparticles and attaching the metal nanoparticles in the plating solution to a plating target, it is possible to perform plating on various plating targets without implementing a pretreatment thereon or the like.

That is, the object of the present disclosure relates to a novel plating method, a bubble ejection member and a plating apparatus used for the plating method, and a novel device.

Solution to Problem

The present disclosure relates to a plating method, a bubble ejection member, a plating apparatus, and a device illustrated below.

(1) A plating method performed on a plating target using a plating solution, the plating method comprising at least:

a bubble ejection step of ejecting a bubble generated by a bubble ejection member to a plating solution, wherein the bubble ejection member includes an electrode formed of a conductive material, and an insulating material covering at least a part of the electrode, and wherein at least a part of the insulating material forms a bubble ejection port, and an air gap surrounded by the insulating material is formed between at least a part of the electrode and the bubble ejection port.

(2) The plating method according to (1) above, wherein the plating solution contains metal ions, and wherein the metal ions in the plating solution are converted into a metal by ejecting a bubble generated by the bubble ejection member to the plating solution in the bubble ejection step.

(3) The plating method according to claim 1 or 2, wherein the plating solution contains metal nanoparticles.

(4) The plating method according to any one of claims 1 to 3, wherein the bubble ejection step forms a recess in the plating target by the ejected bubble, and a metal is formed inside the recess.

(5) The plating method according to any one of (1) to (4) above, wherein the bubble ejection step forms a metal on the plating target continuously by ejecting bubbles while changing a relative position of the bubble ejection port and the plating target.

(6) The plating method according to any one of (1) to (5) above, wherein the bubble ejection member includes a flow path to supply the plating solution to at least a part of the electrode, wherein the flow path is formed inside the electrode, and/or formed by a combination of the electrode and the insulating material.

(7) The plating method according to any one of (1) to (6) above, wherein at least a part of the electrode has an acute shape.

(8) The plating method according to any one of (1) to (7) above, wherein the plating target is of a type selected from a metal, a resin, an animal, or a plant.

(9) A bubble ejection member comprising:

an electrode formed of a conductive material; and an insulating material covering at least a part of the electrode, wherein at least a part of the insulating material forms a bubble ejection port, and an air gap surrounded by the insulating material is formed between at least a part of the electrode and the bubble ejection port, wherein the bubble ejection member includes a flow path to supply a liquid to at least a part of the electrode, wherein the flow path is formed inside the electrode, and/or formed by a combination of the electrode and the insulating material.

(10) The bubble ejection member according to (9) above, wherein at least a part of the electrode has an acute shape.

(11) A plating apparatus comprising:

the bubble ejection member according to (9) or (10) above; and an electrical output mechanism that causes a bubble to be ejected from the bubble ejection member.

(12) A device comprising at least a substrate, a recess formed in the substrate, and a metal layer formed inside the recess, wherein the recess is formed from a substrate surface toward a substrate internal portion, wherein when the recess is viewed in a cross section in a direction substantially perpendicular to the substrate surface, and distances in the recess are compared by a distance parallel to the substrate surface, the substrate internal portion of the recess has a shape having a portion longer than a length of an opening of the recess in the substrate.

(13) The device according to (12) above, wherein recesses are continuously formed, and a metal is continuously arranged inside the continuously formed recesses.

Advantageous Effect of Invention

The plating method disclosed in the present specification can plate a predetermined position on various plating targets without implementing a pretreatment thereon. Further, the bubble ejection member and the plating apparatus can be suitably used for the plating method. Further, a novel device can be produced by using the plating method disclosed in the present specification.

BRIEF DESCRIPTION OF DRAWINGS

FIG. 8A is a photograph of a tip portion of the bubble ejection member 1*b* produced in Example 1, and FIG. 8B is a photograph of a view in which the bubble ejection member 1*b* is inserted in an RB needle.

FIG. 13A is a photograph of a plating target after plated in Example 6, and FIG. 13B is a photograph of a plating target after plated in Example 7.

FIG. 20A is a photograph before a plating solution is supplied, and FIG. 20B is a photograph after a plating solution is supplied in Example 14.

FIG. 21A is a photograph of a stretched rubber substrate after plated, and FIG. 21B is a photograph of a contracted rubber substrate after a weight is removed in Example 15. FIG. 21C is a photograph illustrating a result of a confirmation experiment of a conductivity capacity of a plated portion.

DESCRIPTION OF EMBODIMENTS

A plating method, a bubble ejection member, a plating apparatus, and a device will be described below in detail with reference to the drawings.

Figure 1:
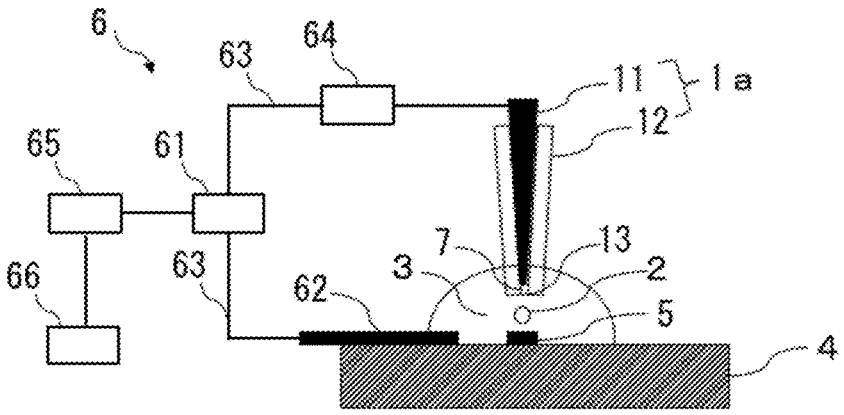
FIG. 1 is a schematic diagram illustrating a first embodiment of a plating method.

First, a plating method will be described. FIG. 1 is a schematic diagram illustrating a first embodiment of a plating method. In the embodiment illustrated in FIG. 1, a bubble 2 generated by a bubble ejection member 1*a* is ejected from a bubble ejection port 13 of the bubble ejection member 1*a* to a plating solution 3, thereby metal ions in a plating solution 3 are metalized, and plating 5 can be performed (a metal layer can be formed) on a plating target 4.

As described later, the embodiment of the bubble ejection member 1*a* is not particularly limited as long as it includes an electrode 11 formed of a conductive material and an insulating material 12 covering at least a part of the electrode 11 and can eject the bubble 2 from the bubble ejection port 13 into the plating solution 3 in response to application of a voltage to the electrode 11.

In the present specification, the term "plating solution" means a solution containing metal ions and/or a solution containing metal nanoparticles used for forming the plating (metal layer) 5, for example. The metal (metal ion) may be silver, gold, zinc, chromium, tin, nickel, copper, platinum, cobalt, or the like. The plating solution containing metal ions can be produced by dissolving a salt including the above metal or the like in a solvent. The solvent is not particularly limited as long as it can dissolve a salt including a metal or the like and may be pure water, a saline solution, or the like. Further, multiple types of metals (metal ions) illustrated as examples may be combined to produce alloy plating (alloy layer) 5. The plating solution containing metal nanoparticles can be produced by dispersing the above metal nanoparticles in the above solvent. The size of the metal nanoparticle may be around 10 nm to 500 nm. Further, in addition to the production by using the above method, one or more known plating solutions containing metal ions illustrated as examples may be used alone or in combination for the plating solution 3.

The plating target 4 is not particularly limited as long as it can be plated by the plating method illustrated in the embodiment. For example, a substrate generally used for producing a circuit board may be used, more specifically, a resin substrate using a resin such as silicon, glass epoxy, polyester, polyimide, BT resin, and thermosetting polyphenylene ether; an inorganic substrate using an inorganic material, such as an alumina (ceramics) substrate; a metal substrate such as a silicon wafer, aluminum, or copper; or a metal base substrate in which an insulating layer is overlayered on the metal substrate and a copper foil, which is a conductor, is further overlayered thereon; or the like may be used.

Further, as illustrated in Examples described later, as long as the plating solution 3 is present in front of the bubble 2 ejected from the bubble ejection port 13, the plating method according to the embodiment can plate the plating target 4 behind the plating solution 3. Therefore, since there is no need for an apparatus such as a bath or a vacuum chamber in which the plating solution 3 is filled, it is possible to plate various targets such as a structure made of an organic material such as an animal, a plant, or a resin or an inorganic material other than the above substrate or the like. Further, with respect to the shape of the plating target 4, it is possible to plate targets of various shapes such as a shape with a curved surface, a thin and long shape such as a thread, or the like without being limited to a flat plate or the like.

With the bubble ejection member 1*a* and an electrical output mechanism 6 being combined, "plating apparatus" that ejects the bubble 2 can be produced. The electrical output mechanism 6 may be any mechanism that includes at least a power supply apparatus 61, a counter electrode 62, and an electrical cable 63 used for forming a circuit including the power supply apparatus 61, the electrode 11 of the bubble ejection member 1*a*, and the counter electrode 62. Further, a noninductive resistor 64, a voltage amplifier circuit (not illustrated), an input/output port (Digital Input Output (DIO)) 65, a control apparatus 66 such as a PC that controls the power supply apparatus 61, or the like may be provided if necessary. The electrical output mechanism 6 may be produced by preparing the above components or may be produced by embedding the noninductive resistor 64, the input/output port 65, or the like into a conventional electric circuit used for an electrical scalpel.

Note that, although formed as a separate member from the bubble ejection member 1*a* in the embodiment illustrated in FIG. 1, the counter electrode 62 may be embedded in the bubble ejection member when a flow path to supply a plating solution is formed in the bubble ejection member, as described later.

As the power supply apparatus 61, a general AC power supply apparatus can be used. The current, voltage, and frequency output from the electrical output mechanism 6 to the electrode 11 and the counter electrode 62 are not particularly limited as long as the bubble 2 can be ejected to the plating solution 3, and thereby the metal ions in the plating solution 3 can be metalized and the metal layer 5 can be formed on a plating target or otherwise the metal layer 5 can be formed on a plating target with the metal nanoparticles in the plating solution 3. For example, the current may be set to 1 mA to 500 mA or 50 mA to 200 mA to prevent unsuccessful generation of bubbles or occurrence of wear of the electrode. For example, the voltage may be set to 200 V to 4000 V or 600 V to 1800 V to prevent difficulty in bubble generation, wear of the electrode 11, or damage on the bubble ejection member 1. The pulse width is preferably 500 ns to 1 ms, and more preferably 1 μs to 100 μs. If the pulse width is shorter than 500 ns, no bubble may be ejected, and if the pulse width is longer than 1 ms, the bubble is not suitably ejected.

Note that the plating method of the first embodiment can also form the metal layer 5 on the plating target 4 or form recesses in the plating target 4 and form the metal layer 5 inside the recesses by adjusting the voltage or the number of times of application of the voltage to the electrode, that is, by adjusting the strength and the number of times of collision of the bubbles 2 with the plating target 4. Alternatively, whether or not to form recesses may be adjusted by changing the distance between the plating target 4 and the bubble ejection port 13 to adjust the strength of collision of the bubbles 2 with the plating target 4.

Figure 2:
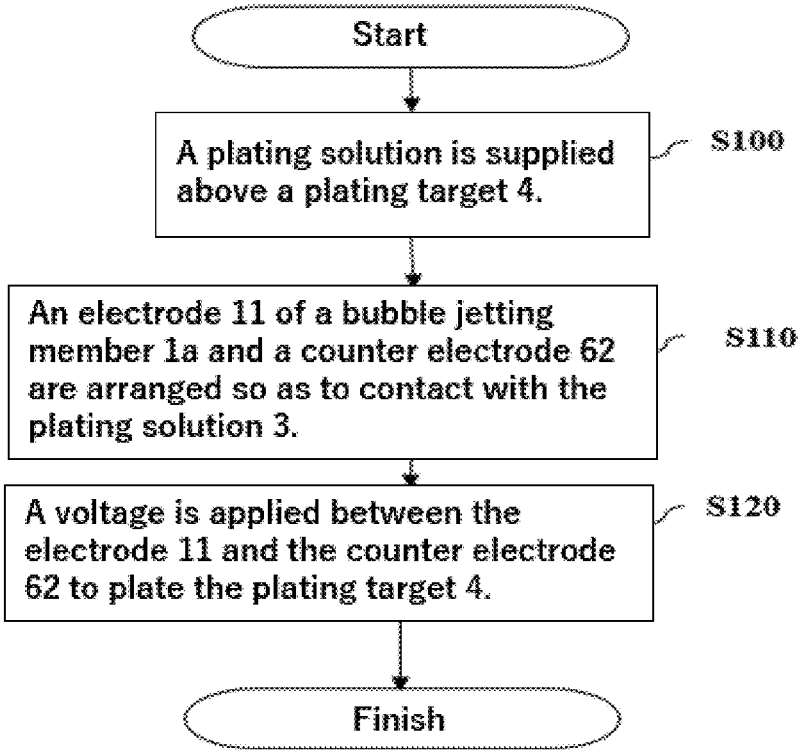
FIG. 2 is a flowchart illustrating a more specific procedure of the plating method according to the first embodiment.

FIG. 2 is a flowchart illustrating a more specific procedure of the plating method according to the first embodiment.

(1) The plating solution 3 is supplied above the plating target 4 (S100). The plating solution 3 can be spotted on an intended plating portion of the plating target 4 by using a syringe or the like.

(2) The electrode 11 of the bubble ejection member 1*a* and the counter electrode 62 are arranged so as to contact with the plating solution 3 (S110).

(3) A voltage is applied between the electrode 11 and the counter electrode 62 to plate the plating target 4 (S120).

The bubble ejection member 1*a* according to the first embodiment can be produced by the following procedure.

(1) A hollow insulating material 12 is prepared, and the electrode 11 formed of a conductive material is inserted in the hollow insulating material 12, and both are heated, pulled, and cut.

(2) Due to the difference in viscoelasticity between the insulating material 12 and the electrode 11, the bubble ejection member 1*a* in which at least a part, for example, the tip part of the electrode 11 is covered with the insulating material 12 can be produced. At this time, at least a part, for example, the tip part of the insulating material 12 forms the bubble ejection port 13, and an air gap 7 surrounded by the insulating material 12 is formed between at least a part of the electrode 11, for example, the tip part of the electrode 11 and the bubble ejection port 13.

The insulating material 12 is not particularly limited as long as it provides electrical insulation and may be, for example, an inorganic insulating material such as glass, mica, silicon nitride, silicon oxide, ceramic, or alumina, a rubber material such as a silicone rubber or an ethylene propylene rubber, or an insulating resin such as an ethylene vinylacetate copolymer resin, a silane modified olefin resin, an epoxy resin, a polyester resin, a vinyl chloride based resin, an acrylic resin, a melamine resin, a phenol resin, a polyurethane resin, a polystyrene based resin, a fluorine based resin, a silicon based resin, a polysulfide based resin, a polyamide resin, a polyimide resin, polyethylene, polypropylene, a cellulose based resin, or a UV curable resin.

The conductive material forming the electrode 11 is not particularly limited as long as it provides electrical conduction and can be used as an electrode and may be a metal such as gold, silver, copper, or aluminum, for example, an alloy in which a small amount of tin, magnesium, chromium, nickel, zirconium, iron, silicon, or the like is added to the above metal, or the like.

In the bubble ejection member 1*a* used in the first embodiment, since a bubble once formed in the air gap 7 is ejected from the bubble ejection port 13 so as to be pulled and cut in response to power output, it is not required to externally supply a gas to the bubble ejection member 1*a*. Therefore, the electrode 11 is formed in a solid state of the extended conductive material, and no pipe or the like that supplies an air is formed inside the electrode 11. Further, at least a part of the insulating material 12 is fit to the electrode 11 at the tip part of the electrode 11 near the tip of the bubble ejection member 1*a* due to the difference in viscoelasticity between the insulating material 12 and the electrode 11, however, a gap may be formed between the electrode 11 and the insulating material 12 as far as a bubble can be ejected. Further, in the present specification, reference to the tip part of the electrode 11 does not mean a point at the farthest end on the structure of the electrode 11 but means a portion where charges are concentrated due to application of a voltage and which contributes to generation and ejection of a bubble. Therefore, without being limited to the tip part on the structure of the electrode 11, a tip part where charges are concentrated and which contributes to generation and ejection of a bubble may be formed in any place on the structure of the electrode 11 as long as charges can be concentrated and a bubble can be ejected.

The size of a bubble to be ejected can be adjusted by changing the diameter of the bubble ejection port 13. Note that, when the plating method is implemented, the air gap 7 of the bubble ejection member 1*a* is required to be filled with the plating solution 3 by a capillary phenomenon. Thus, the diameter of the bubble ejection port 13 is required to be the size through which a plating solution can pass due to the capillary phenomenon and may be, for example, around 500 nm or longer, 1 μm or longer, or 3 μm or longer. On the other hand, the upper limit is not particularly limited as far as the bubble 2 can be ejected and plating can be performed on the plating target 4 and may be, for example, 1 mm or smaller, 500 μm or smaller, or 100 μm or smaller. The diameter of the bubble ejection port 13 can be adjusted by the temperature during heating and the rate of pulling and cutting. Further, after the pulling and cutting, adjustment may be made by pressing a heating unit such as a micro-forge against the bubble ejection port 13.

Further, the bubble ejection member 1*a* that can be used in the first embodiment may be a multi-cylinder bubble ejection chip including bubble ejection portions formed on a substrate. The bubble ejection portion can be produced by being formed to include:

an electrode formed of a conductive material;

an insulating portion formed of an insulating photosensitive resin, provided so as to interpose the electrode, and including an extending portion extending from the tip of the electrode; and the air gap 7 formed between the extending portion of the insulating portion and the tip of the electrode. International Publication No. WO2016/052511 can be referenced for the specific production procedure of the multi-cylinder bubble ejection chip.

Figure 3:
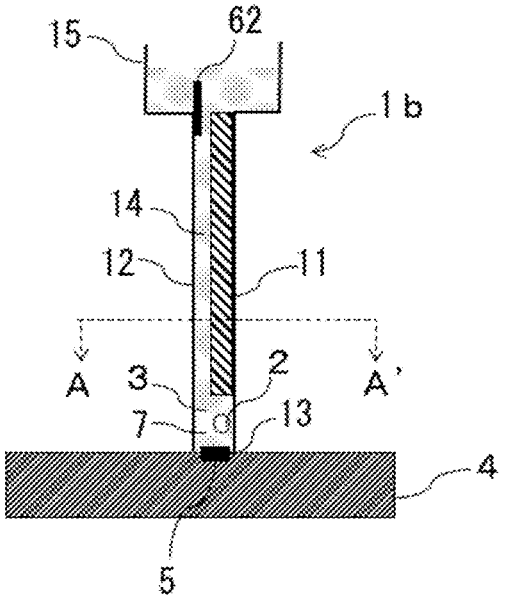
FIG. 3 is a sectional view illustrating an example of a bubble ejection member 1*b* used for a plating method of a second embodiment.

FIG. 3 is a sectional view illustrating an example of a bubble ejection member 1*b* used in a plating method of a second embodiment. Note that, when the bubble ejection member 1*b* is used, the counter electrode 62 may be a separate member from the bubble ejection member 1*b* or may be embedded as a component of the bubble ejection member 1*b* in any place that is in contact with a liquid (the plating solution 3). Since the electrical output mechanism except for the counter electrode 62 is the same as that of the first embodiment, the description thereof will be omitted. The bubble ejection member 1*b* used in the plating method of the second embodiment includes a flow path 14 used for supplying a liquid (the plating solution 3) and thus can supply the plating solution 3 to at least a part, for example, the tip part of the electrode 11 through the flow path 14, which makes a difference from the bubble ejection member 1*a* of the first embodiment. The bubble ejection member 1*b* will be described below more specifically with reference to the drawings.

The flow path 14 of the bubble ejection member 1*b* can be formed of a combination of the electrode 11 and the insulating material 12 or formed inside the electrode 11, for example. FIG. 3 illustrates an example in which the flow path 14 is formed of a combination of the electrode 11 and the insulating material 12. Further, if necessary, the bubble ejection member 1*b* may have a reservoir 15 for a liquid (the plating solution 3) to be supplied to the flow path 14. When provided, the counter electrode 62 can be provided in the flow path 14 or the reservoir 15 in a manner separate from the electrode 11.

Figure 4:
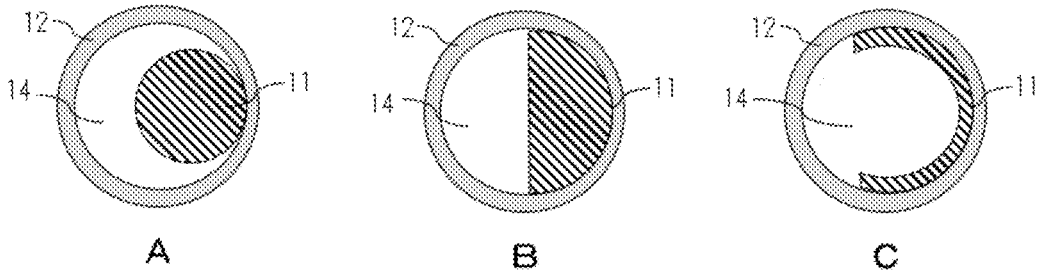
FIG. 4A to FIG. 4C illustrate examples in which a flow path 14 is formed by a combination of an electrode 11 and an insulating material 12 in a sectional view taken along a line A-A' of FIG. 3.

FIG. 4A to FIG. 4C are sectional views taken along a line A-A' of FIG. 3 and each illustrate an example in which the flow path 14 is formed of a combination of the electrode 11 and the insulating material 12. FIG. 4A illustrates an example in which the flow path 14 is formed by inserting a bar-shaped solid electrode 11 in the insulating material 12 having an inner diameter larger than the outer diameter of the electrode 11. FIG. 4B illustrates an example in which the flow path 14 is formed by inserting a solid electrode 11 having a semicircular cross section in the insulating material 12 having substantially the same inner diameter as the longer axis length of the electrode 11. Further, FIG. 4C illustrates an example in which the flow path 14 is formed by inserting an electrode 11 having a substantial U-shaped (substantially hollow) cross section in the insulating material 12 having substantially the same inner diameter as the outer diameter of the electrode 11. Note that each embodiment illustrated in FIG. 4A to FIG. 4C is a mere example of the flow path 14 formed of a combination of the electrode 11 and the insulating material 12, and other shapes may be employed. Note that the electrode 11 of each embodiment illustrated in FIG. 4A to FIG. 4C is a bare conductive material that is not covered with an insulating material or the like.

Figure 5:
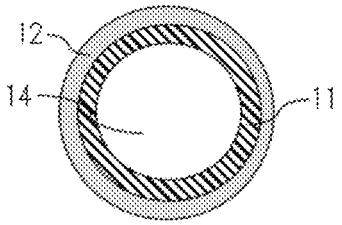
FIG. 5 illustrates an example in which a flow path 14 is formed inside the electrode 11 in the bubble ejection member 1*b* used in the second embodiment.

FIG. 5 illustrates an example in which the flow path 14 is formed inside the electrode 11 in the bubble ejection member 1*b* used in the second embodiment. The embodiment illustrated in FIG. 5 illustrates an example in which the flow path 14 is formed by inserting an electrode 11 having a hollow cross section in the insulating material 12 having substantially the same inner diameter as the outer diameter of the electrode 11. Note that the flow path 14 may be formed by combining a part inside the electrode 11 and a part between the electrode 11 and the insulating material 12, that is, combining the embodiments illustrated in FIG. 4 and FIG. 5.

In the bubble ejection member 1*b*, the material forming the electrode 11 may be the same as the material forming the electrode 11 of the bubble ejection member 1*a*. Note that, in the bubble ejection member 1*b*, the electrode 11 is different from the electrode 11 of the bubble ejection member 1*a* in that the electrode 11 of the bubble ejection member 1*b* is formed in the shape illustrated in FIG. 4A to FIG. 4C and FIG. 5 in advance.

In the bubble ejection member 1*b*, the material forming the insulating material 12 may also be the same as the material forming the insulating material 12 of the bubble ejection member 1*a*. Note that, in the bubble ejection member 1*b*, the insulating material 12 is different from the insulating material 12 of the bubble ejection member 1*a* in that the insulating material 12 of the bubble ejection member 1*b* formed so as to be hollow in advance is used without being heated. Note that the size of the bubble ejection port 13 formed in at least a part, for example, the tip part of the insulating material 12 is the same as that of the bubble ejection member 1*a*.

Figure 6:
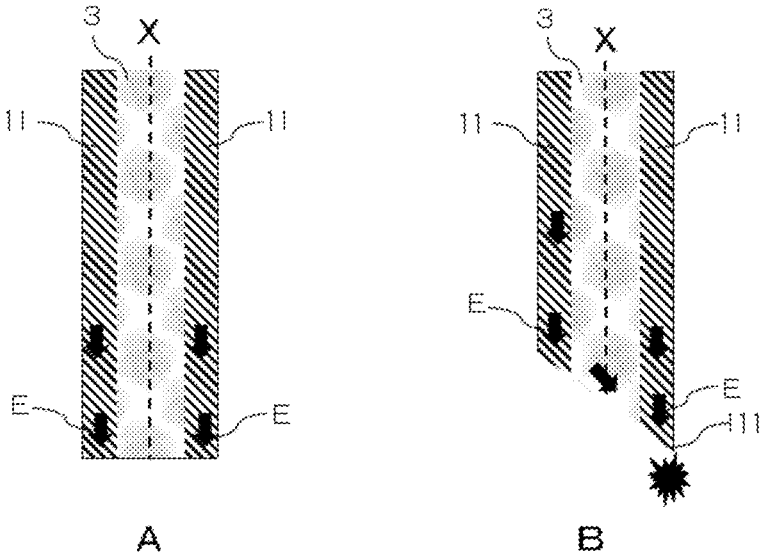
FIG. 6A and FIG. 6B are schematic sectional views illustrating the shape of the tip part of the electrode 11 of the bubble ejection member 1*b*.

FIG. 6A and FIG. 6B are schematic sectional views illustrating the shape of at least a part, for example, the tip part of the electrode 11 of the bubble ejection member 1*b*. When a voltage is applied to the electrode 11, if the tip part of the electrode 11 has a shape substantially orthogonal to the longer axis direction X of the electrode 11 as illustrated in FIG. 6A, charges E applied to the electrode 11 are dispersed in the tip part. Thus, although the bubbles 2 can be generated, the portions where the bubbles 2 occur are likely to be dispersed. On the other hand, as illustrated in FIG. 6B, when the tip part of the electrode 11 is formed in an acute shape (acute portion) 111 to cause the charges E to be easily concentrated in the acute portion 111, the places where the bubbles 2 occur are likely to be the same. To make the acute shape (acute portion) 111, the tip part of the electrode 11 can be cut so that the tip part is inclined with respect to the longer axis X of the electrode 11, for example. Note that the acute portion 111 is located in a single portion in the embodiment illustrated in FIG. 6B. Although it is preferable that the acute portion 111 be provided in a single portion in terms of concentration of the charges E, acute portions may be provided in multiple portions. Further, although an example of the case of the use of the hollow electrode 11 illustrated in FIG. 5 is illustrated in FIG. 6, the tip part may have the acute shape (acute portion) 111 also in the case of each electrode 11 illustrated in FIG. 4A to 4C. Note that, also in the bubble ejection member 1*b* of the second embodiment, reference to the tip part of the electrode 11 means the same as in the bubble ejection member 1*a* of the first embodiment.

Although the examples of the bubble ejection members 1*a* (including the multi-cylinder bubble ejection chip) and 1*b* have been illustrated with reference to FIG. 1 and FIG. 3 to FIG. 5, the bubble ejection members 1*a* and 1*b* are mere examples. A bubble ejection member used for the plating method may have a configuration other than the bubble ejection members 1*a* and 1*b* as long as it can plate a plating target by ejecting bubbles into a plating solution. Further, in the present specification, "an air gap surrounded by an insulating material between at least a part of an electrode and a bubble ejection port" means that an air gap (space) surrounded by an insulating material is formed between "at least a part of an electrode" and "a bubble ejection port". For example, both (1) a configuration in which the circumference of the air gap 7 is defined by the electrode 11, the insulating material 12, and the bubble ejection port 13 as with the bubble ejection member 1*a* and (2) a configuration in which the circumference of the air gap 7 is defined by the electrode 11, the insulating material 12, the bubble ejection port 13, and the flow path 14 as with the bubble ejection member 1*b* are included.

Note that the inventors have already disclosed the bubble ejection member 1*a* using the solid electrode 11 illustrated in the first embodiment and furthermore a gas-liquid ejection member in which an insulating outer shell member is arranged at a position spaced apart from the outer circumference of the bubble ejection member 1*a* (see Japanese Patent No. 5526345). However, Japanese Patent No. 5526345 discloses neither (1) that the flow path 14 is formed inside the electrode 11 by using the hollow electrode 11 nor (2) that the flow path 14 is formed of a combination of the electrode 11 and the insulating material 12. Therefore, the bubble ejection member 1*b* illustrated in the second embodiment is a novel bubble ejection member. Further, the bubble ejection member 1*b* can be suitably used for the plating method according to the second embodiment and further may be used for other uses. For example, with a liquid containing an injection substance such as DNA, RNA, protein, amino acid, or an inorganic substance instead of a plating solution being supplied from the flow path 14 to at least a part, for example, the tip part of the electrode 11, the bubble ejection member 1*b* can be used as one for local injection. Therefore, the liquid supplied to the flow path 14 is not limited to a plating solution.

Figure 7:
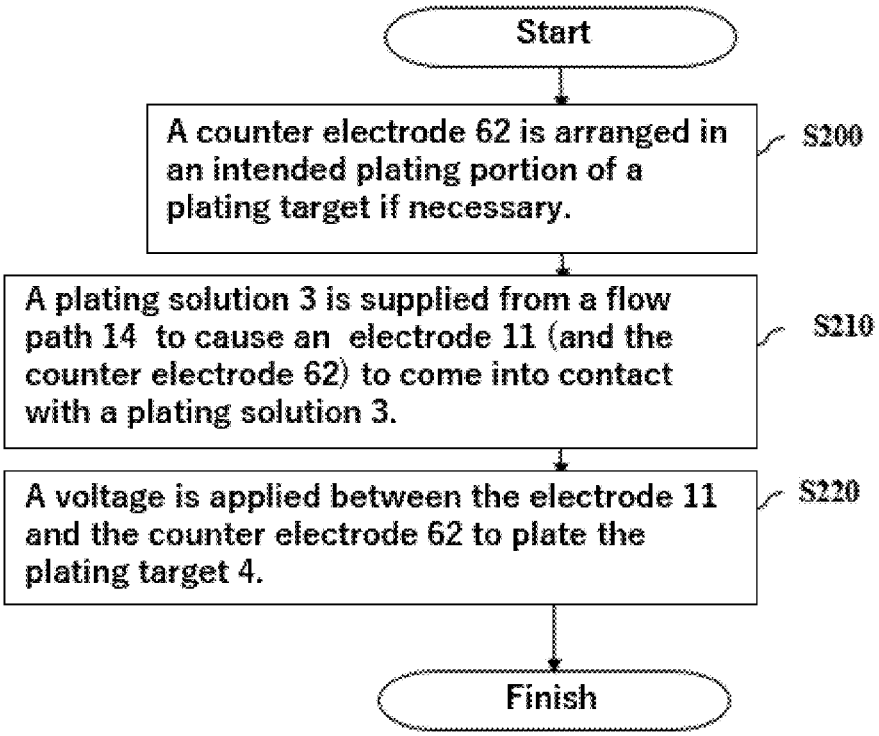
FIG. 7 is a flowchart illustrating a procedure of the plating method according to the second embodiment.

FIG. 7 is a flowchart illustrating a procedure of the plating method according to the second embodiment.

(1) When the counter electrode 62 is a separate member from the bubble ejection member 1*b*, the counter electrode 62 is arranged in an intended plating portion of the plating target 4 (S200). Note that, when the counter electrode 62 is embedded as a component of the bubble ejection member 1*b*, S200 is unnecessary.

(2) The plating solution 3 is supplied from the flow path 14 to at least a part, for example, the tip part of the bubble ejection member 1*b* to cause the electrode 11 (and the counter electrode 62) to come into contact with the plating solution 3 (S210).

(3) A voltage is applied between the electrode 11 and the counter electrode 62 to plate the plating target 4 (S220).

The plating method according to the first and second embodiments (hereinafter, which may be referred to as "the present plating method") can be used for a use such as the following device production, for example.

(1) Production of a capacitor; in production of a capacitor, fine unevenness may be provided in a substrate in order to increase the surface area. With a use of the present plating method, production of unevenness and formation of a metal layer can be made at the same time, which enables efficient production.

(2) An anchor for fixing a magnetic material; with a use of the present plating method, fine recesses to which Ni is attached can be formed in a plating target, for example. This can be used as an anchor used for erecting a fine iron pole on the plating target or fixing a magnetic bead by means of magnetic force.

(3) Improvement of heat dissipation; recesses are formed in a heat exchange component or the like and plated with a high dissipation metal by using the present plating method, and thereby heat dissipation efficiency can be improved due to an increase in the surface area and formation of a metal layer having high heat dissipation.

(4) Writing of information; for example, metal layers are formed in a plurality of portions on a substrate by using two types of different plating solutions, and thereby binary processing information can be embedded. Needless to say, an increase of types of metals enables multi-level processing information to be embedded.

(5) Application of individual identification information; while the plating target is a substrate in the above (4), for example, a metal is embedded in a body of an animal or the like in accordance with the present plating method, the embedded metal is read by using an external sensor, and thereby an individual can be identified. Needless to say, information can also be embedded by embedding multiple types of metals if necessary.

Although the use illustrated above as an example is a use when spacing is provided and plating is performed (a metal layer is formed) on the plating target 4, it is possible to form a metal continuously on a plating target by ejecting bubbles while changing the relative position of the bubble ejection port and the plating target in the bubble ejection process. Further, by adjusting the power output mechanism, it is also possible to form recesses continuously in a plating target and form a metal layer continuously inside the recesses. In such a case, this can also be used for a use of production of a circuit because the circuit can be formed of the plated metal layer.

The present plating method is not required to dip a plating target in a plating solution but only needs to supply a plating solution to only a plating target portion. Therefore, the present plating method provides significant advantageous effects that the amount of a plating solution can be reduced and that plating can be performed on a plating target at any place such as outdoor.

Further, when plating a substrate by the present plating method, it is possible to grind off the substrate to form a recess by adjusting the ejection strength of the bubble 2. At this time, as illustrated in the example described later, a recess is formed from the substrate surface toward the substrate internal portion, and is shaped such that the substrate internal portion of the recess has a portion longer than the length of the opening of the substrate when the recess is viewed in a cross section taken along a direction substantially perpendicular to the substrate surface and the distances in the recess are compared by the distance parallel to the substrate surface. That is, in the recess of the substrate produced by the present plating method, the length of the internal portion is larger than the length of the opening.

As indicated in Patent Literatures 1 and 2, a technology of forming a metal layer in a recess formed by etching or transcription of a mold is known. When a recess is formed by etching or transcription of a mold, however, the distance of an internal portion of a recess is typically the same as or narrower than that of the opening. On the other hand, since the distance of the internal portion is larger than the length of the opening of the recess and the metal layer is formed inside the recess, the substrate plated by the present plating method provides an advantageous effect that a metal layer is less likely to be detached. Therefore, a device produced by the present plating method is a novel device having a recess shape different from the conventional recess shape.

Although examples will be presented below to specifically describe each embodiment, these examples are provided only for the purpose of reference of a specific aspect thereof. These illustrations are not intended to limit or restrict the scope of the invention.

EXAMPLES

Example 1

[Production of Bubble Ejection Member 1*b*]

Figure 8:
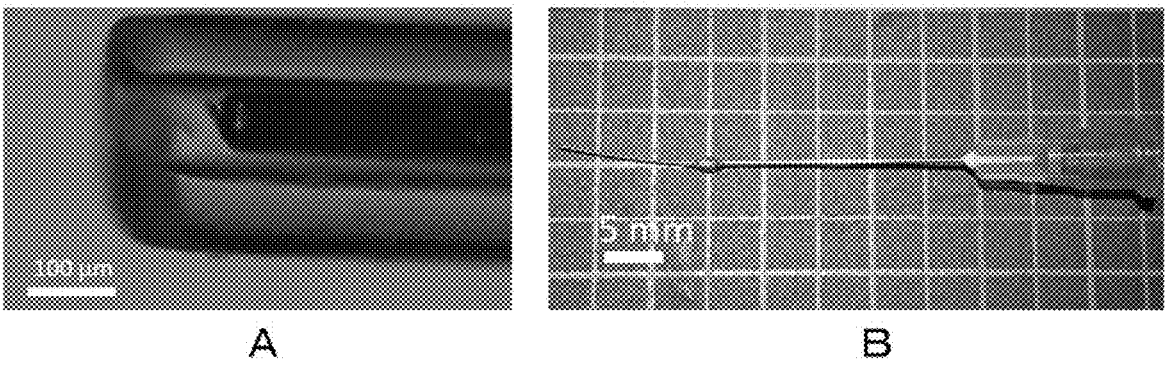
FIG. 8A and FIG. 8B are photographs substitute for drawing.

First, a PFA micro-tube (outer diameter: 0.3 mm, inner diameter: 0.1 mm; by AS ONE Corporation) was cut into a piece of around 1 to 2 cm, and a hollow copper pipe (outer diameter: 0.08 mm, inner diameter: 0.03 mm, by NIPPON TOKUSHUKAN MFG. CO., LTD.) was cut into a piece of around 2 to 3 cm, and the cut hollow copper pipe was inserted in the cut PFA micro-tube. At this time, insertion was made so that an air gap of around 50 to 150 μm is formed between the tip of the tube (the insulating material 12) and the tip of the copper pipe (the electrode 11). An instantaneous adhesive agent Aron Alpha jelly type (by TOAGOSEI CO., LTD.) was then used to adhere and fix the tube and the copper pipe to each other, and thereby the bubble ejection member 1*b* was produced. FIG. 8A is a photograph of the tip portion of the produced bubble ejection member 1*b*. Note that the tip part of the electrode 11 was not processed to have an acute shape, and the purchased copper pipe was used without change. Next, to facilitate connection to a plating apparatus described later, a portion where the copper pipe of the produced tube including the copper pipe is exposed is inserted inside the needle tip of an RB needle, Neolus, 25G×1 (by Terumo Corporation) and fixed so as to prevent removal by using an adhesive agent SUPERX clear (by CEMEDINE Co., Ltd.) with the copper pipe and the RB needle being in contact with each other. FIG. 8B is a photograph of a view in which the bubble ejection member 1*b* is inserted in the RB needle.

Example 2

[Production of Plating Apparatus]

Next, the needle portion of the RB needle of Example 1 and a scalpel tip electrode/pure chip (disposable) (by Japan Medicalnext Co., Ltd.) of a medical electrical scalpel were connected via a tungsten wire. The connecting portion was adhered by using an Ag paste (by Epoxy Technology, Inc. (EPO-TEK)). At this time, the tip part of the scalpel tip electrode was cut off by around 1 to 2 cm. A proper amount of the Ag paste was applied to a necessary portion, and the portion with the Ag paste was heated and thus hardened at 140 degrees Celsius for 20 minutes on a hot plate (HOT PLATE HP-2SA by AS ONE Corporation). The scalpel tip electrode/pure chip (disposable) (by Japan Medicalnext Co., Ltd.) was also used as the counter electrode. A general purpose electrical scalpel power supply Hyfrecator 2000 (by CONMED Corporation) was used as the power supply apparatus, the bubble ejection member 1*b* and the counter electrode were electrically connected by an electrical cable, and thereby a plating apparatus was produced.

Reference Example 1

[Production of Plating Apparatus Using Bubble Ejection Member 1*a*]

Figure 9:
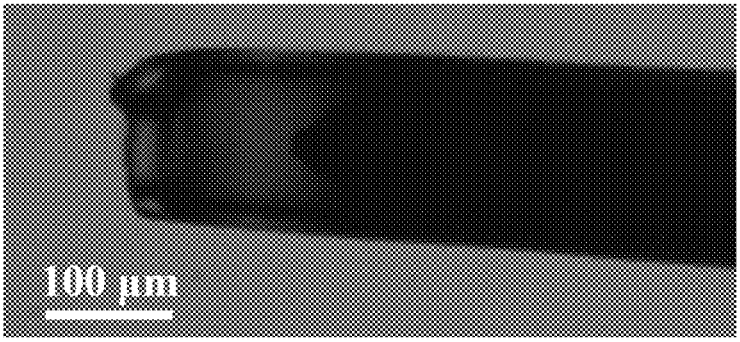
FIG. 9 is a photograph substitute for drawing, which is a photograph of a tip portion of the bubble ejection member 1*a* produced in Reference example 1.

First, a copper wire (diameter: 100 μm, by Nilaco Corporation) was passed through a micro-pipet borosilicate glass pipe (outer diameter: 1.37 mm, inner diameter: 0.93 mm) (by World precision instruments), and both were pulled and cut while being heated by a glass puller PC-10 (by NARISHIGE Group), and thereby the bubble ejection member 1*a* was produced. At this time, due to the difference of viscosity between the glass (the insulating material 12) and the copper (the electrode 11), a difference occurred between the copper wire tip and the end face of the glass pipe, and the glass pipe more extended than the copper wire. Due to this phenomenon, an air gap was formed between the copper wire tip and the end face of the glass pipe. The tip of the glass pipe was in an extending state to be longer than the copper wire by 100 to 200 μm. FIG. 9 is a photograph of the tip portion of the produced bubble ejection member 1*a*.

Example 3

[Production of Plating Apparatus]

Next, the bubble ejection member 1*a* produced in Reference example 1 was used to produce a plating apparatus in accordance with the same procedure as that in Example 2.

[Implementation of Plating Method on Plating Target]

First, materials used in the example and the plating method will be described below.

[Plating Target]

(1) PDMS (solvent:curing agent=10:1, by DuPont Toray Specialty Materials K.K.)

(2) Plastic plate (styrene resin, by TAMIYA INC.)

(3) Silicon wafer (4 inches, Si one-side mirror wafer, by MATSUZAKI SEISAKUSHO CO., LTD.)

(4) Epoxy based resin (Photoreactive Resin Clear, by Formlabs)

(5) Chicken breast (6) Metal (tin plate (Sn), by Nilaco Corporation)

[Plating Solution]

(1) Nickel sulfamate solution. The compositions are as follows.

High impurity 60% nickel sulfamate solution (NIHON KAGAKU SANGYO CO., LTD.): 450 g/L Pure water: proper amount Boric acid: (FUJIFILM Wako Pure Chemical Corporation): 30 g/L Amidosulfuric acid (FUJIFILM Wako Pure Chemical Corporation): proper amount Pitless S (NIHON KAGAKU SANGYO CO., LTD.): proper amount NSF-E (NIHON KAGAKU SANGYO CO., LTD.): proper amount (2) Copper (II) sulfate solution. The compositions are as follows.

Copper (II) sulfate (FUJIFILM Wako Pure Chemical Corporation): 200 g/L

[Plating Method]

The plating solution was dripped on a plating target to form a droplet of the plating solution. Note that no pretreatment was performed at all on the plating target. Next, the counter electrode was caused to come into contact with the droplet. Next, each tip end of the bubble ejection members 1*a* and 1*b* was inserted in the plating target perpendicularly downward and adjusted and fixed so that the distance between the plating target and the bubble ejection port was 50 to 100 μm. Power was then output from the electrical output mechanism to each of the bubble ejection members 1*a* and 1*b* and the counter electrode, and thereby plating on the plating target was performed.

Example 4

Figure 10:
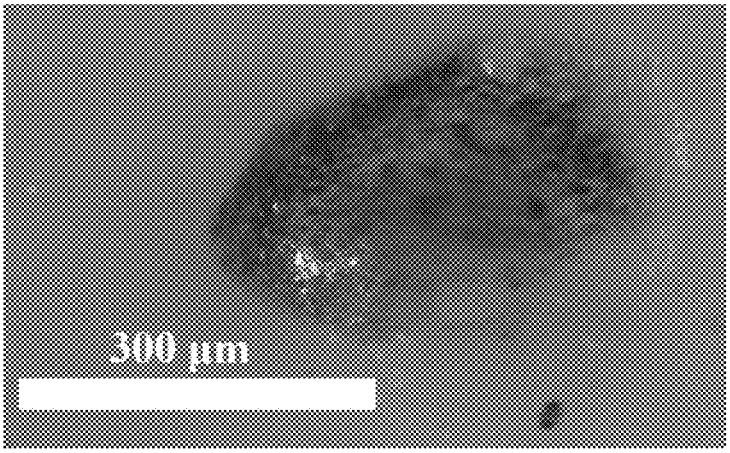
FIG. 10 is a photograph substitute for drawing, which is a photograph of a plating target after plated in Example 4.

The plating apparatus of Example 2, a plastic plate as the plating target, and a nickel sulfamate solution as the plating solution were used. The electrical output conditions were set such that the applied power was 35 W (applied voltage was 2000 V), the number of times of voltage application was 30, and the pulse width was around 1 μs. Note that the experiment was made with the power output being applied via a noninductive resistor of 10.1 kΩ. FIG. 10 is a photograph of the plating target after plated in accordance with Example 4. As indicated in the photograph, it was confirmed that a recess was formed in the plastic plate and a metal layer was formed inside the recess.

Next, the metal layer component inside the recess was checked. In checking the component, a low-vacuum scanning electron microscope (by Hitachi High-Tech Corporation, EDX SU3500) was used for measurement.

Figure 11:
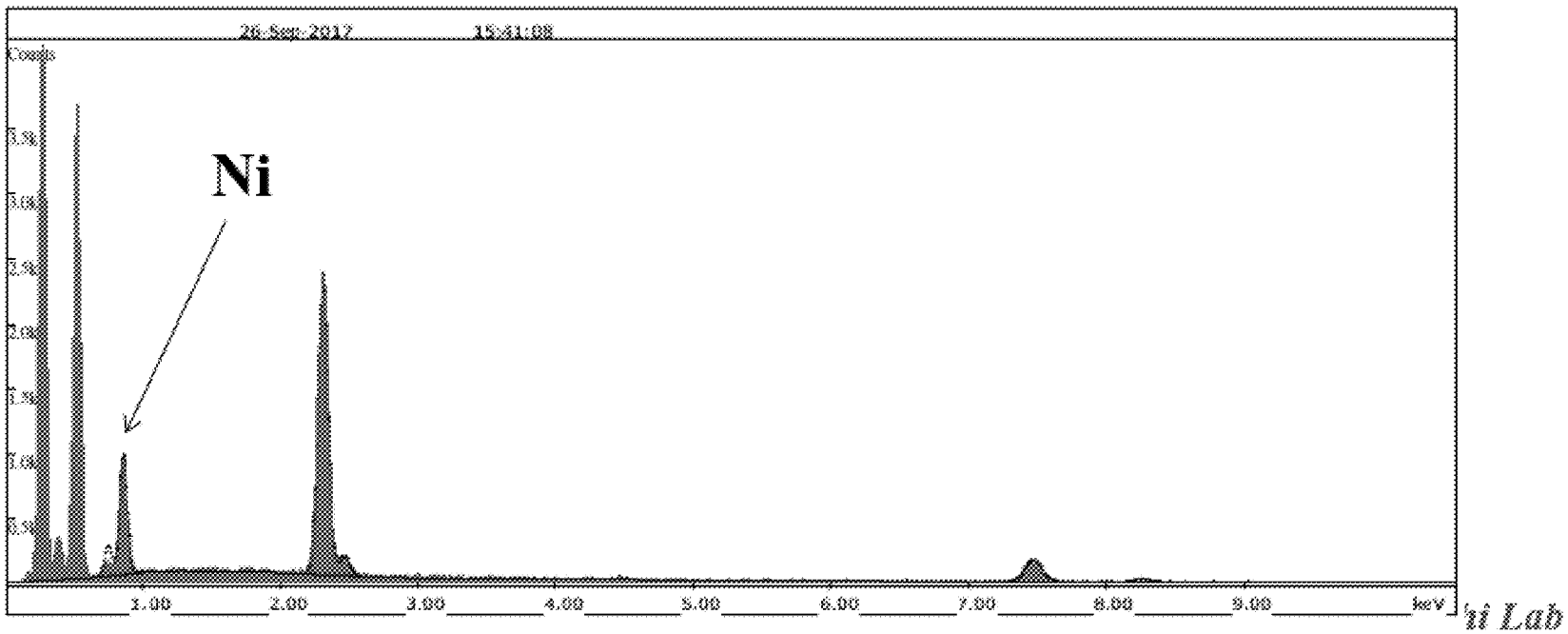
FIG. 11 illustrates a measurement result of a metal layer inside a recess after plated in Example 4.

FIG. 11 illustrates a measurement result. As is apparent from FIG. 11, the peak of Ni was confirmed from a metal layer inside the plated recess. It was confirmed that Ni of the metal layer inside the plated recess originated from a plating solution because no Ni component was included in the plastic plate and the bubble ejection member 1*b*.

Example 5

Figure 12:
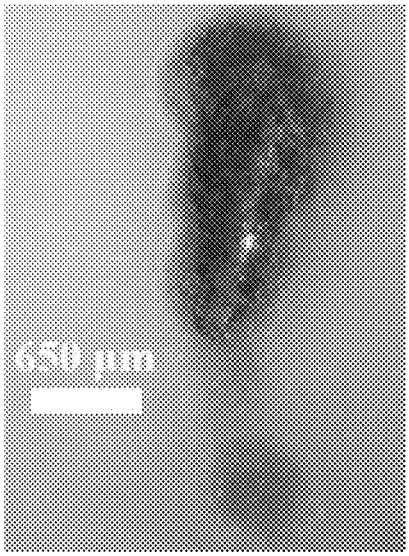
FIG. 12 is a photograph substitute for drawing, which is a photograph of a plating target after plated in Example 5.

Next, in Example 4, bubbles were ejected while the relative position of the plastic plate and the bubble ejection port was changed. FIG. 12 is a photograph of the plating target plated in Example 5. As indicated in the photograph, it was confirmed that recesses were continuously formed in the plastic plate and a metal layer was also continuously formed inside the recesses.

Example 6

Plating was performed in accordance with the same procedure as that in Example 4 except that a copper (II) sulfate solution was used as the plating solution.

Figure 13:
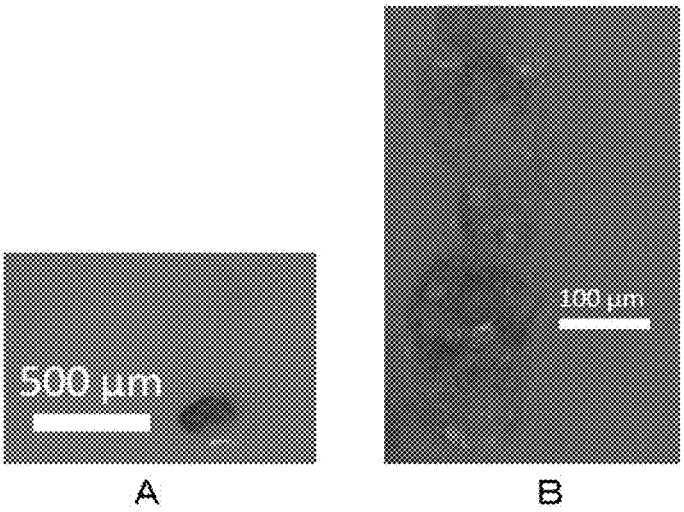
FIG. 13A and FIG. 13B are photographs substitute for drawing.

FIG. 13A is a photograph of the plating target plated in Example 6. As indicated in the photograph, it was confirmed that a metal layer was formed inside the recess also when the copper (II) sulfate was used as the plating solution.

Example 7

Next, bubbles were ejected while the relative position of the plastic plate and the bubble ejection port was changed in Example 6. FIG. 13B is a photograph of the plating target plated in Example 7. As indicated in the photograph, it was confirmed that recesses were continuously formed in the plastic plate and a metal layer was also continuously formed inside the recesses also when the copper sulfate (II) solution was used as the plating solution.

Example 8

Plating was performed in accordance with the same procedure as that in Example 5 except that an epoxy based resin was used as the plating target and the electrical output condition was set to the applied power of 35 W (applied voltage of 2000 V) for 40 times.

Figure 14:
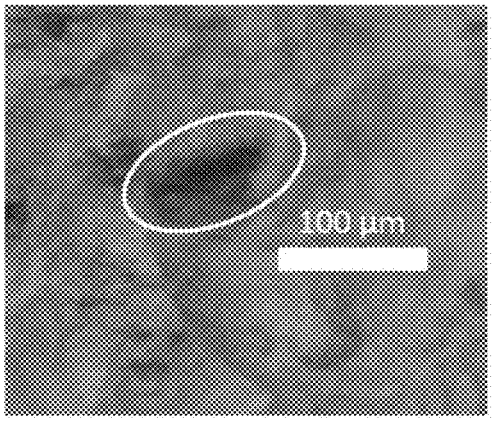
FIG. 14 is a photograph substitute for drawing, which is a photograph of a plating target after plated in Example 8.

FIG. 14 is a photograph of the plating target plated in accordance with Example 8. As indicated in a white circle area in the photograph, it was confirmed that recesses were continuously formed in the epoxy based resin and a metal layer was continuously formed inside the recesses.

Example 9

Plating was performed in accordance with the same procedure as that in Example 6 except that chicken breast was used as the plating target and the electrical output condition was set to the applied power of 7 W (applied voltage of 1000 V) for 30 times.

Figure 15:
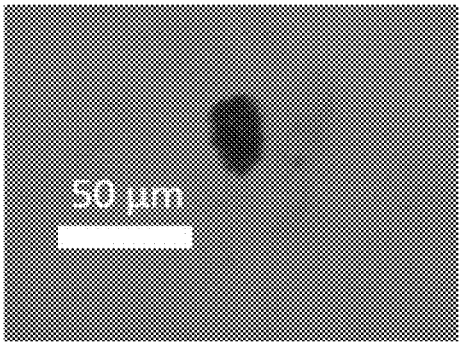
FIG. 15 is a photograph substitute for drawing, which is a photograph of a plating target after plated in Example 9.

FIG. 15 is a photograph of the plating target plated in Example 9. As indicated in a white circle area in the photograph, it was confirmed that a metal was embedded in the chicken breast.

Example 10

Plating was performed in accordance with the same procedure as that in Example 7 except that a silicon wafer was used as the plating target and the electrical output condition was set to the applied power of 15 W (applied voltage of 1500 V) for 10 times.

Figure 16:
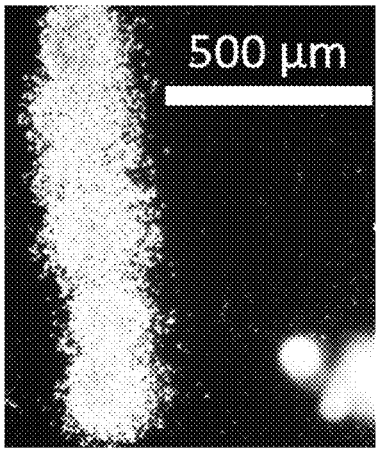
FIG. 16 is a photograph substitute for drawing, which is a photograph of a plating target after plated in Example 10.

FIG. 16 is a photograph of the plating target plated in Example 10. Note that the photograph of Example 10 is a photograph taken by irradiating the plated silicon substrate with light. As is apparent from the photograph, it was confirmed that a metal layer was continuously formed.

Example 11

Plating was performed in accordance with the same procedure as that in Example 6 except that a tin plate was used as the plating target and the electrical output condition was set to the applied power of 15 W (applied voltage of 1500 V) for 40 times.

Figure 17:
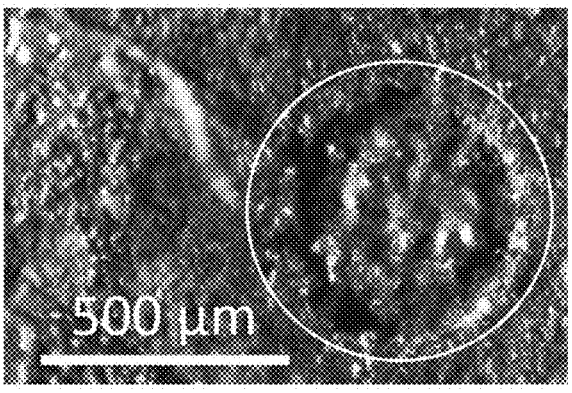
FIG. 17 is a photograph substitute for drawing, which is a photograph of a plating target after plated in Example 11.

FIG. 17 is a photograph of the plating target plated in Example 11. As indicated in a white circle area in the photograph, it was confirmed that a recess was formed in the tin plate.

Example 12

Plating was performed in accordance with the same procedure as that in Example 4 except that a PDMS was used as the plating target and the electrical output condition was set to the applied power of 15 W (applied voltage of 1500 V) for 30 times.

Figure 18:
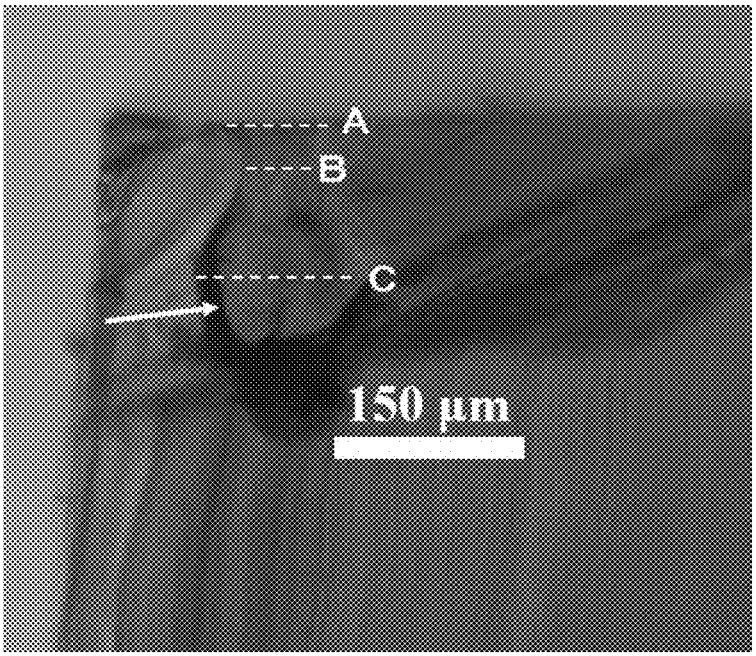
FIG. 18 is a photograph substitute for drawing, which is a photograph of a cross section of a recess after plated in Example 12.

Next, a recess formed by the plating method was cut in substantially the perpendicular direction. FIG. 18 is a photograph of the cross section of the recess after plated in Example 12. When the distances of the recess formed by the present plating method are compared by the distance parallel to the substrate surface, the distance gradually decreases as the position is deeper from the opening of the recess (dotted line A) to the internal portion of the recess (dotted line B), and the distance of the recess then gradually increases as the position thereof is deeper and again decreases as the position is deeper than the position of the maximum distance (dotted line C). Further, the length of the portion at the largest distance inside the recess (dotted line C) is larger than the distance of the portion at the opening (dotted line A). This is considered to be caused by influence of deformation of the substrate material that is cut when the bubble 2 scrapes the substrate.

From the above results, it was confirmed that, when a substrate is plated by the present plating method, a recess formed in the substrate has an internal portion having a larger length than the length of the opening.

Further, the arrow end in the photograph points a metal layer. Since the metal layer is formed inside the recess, the metal layer is not detached even when the substrate surface is rubbed. Therefore, with a substrate being plated by the present plating method, significant advantageous effects that a metal layer can be formed without requiring a pretreatment or the like of the substrate and, moreover, that the wear resistance of the metal layer is improved can be obtained.

Example 13

The plating apparatus of Example 3, a PDMS as the plating target, and a nickel sulfamate solution as the plating solution were used. The electrical output conditions were set to the applied power of 15 W (applied voltage was 1200 V) for 100 times.

Figure 19:
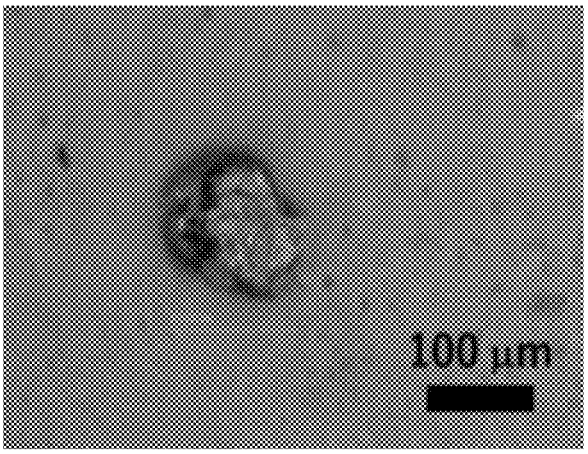
FIG. 19 is a photograph substitute for drawing, which is a photograph of a plating target after plated in Example 13.

FIG. 19 is a photograph of the plating target plated in Example 13. It was confirmed that a recess was formed in the plating target and a metal layer was formed inside the recess.

Example 14

[Supply of Plating solution to Tip Part of Bubble Ejection Member 1*b*]

Figure 20:
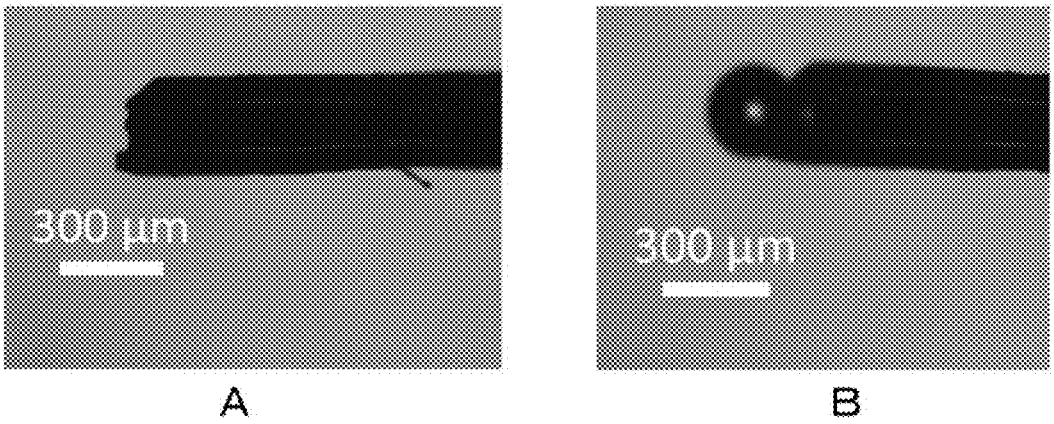
FIG. 20A and FIG. 20B are photographs substitute for drawing.

A copper sulfate (II) solution is supplied inside a copper pipe from the plastic needle hub (the right part of the needle in FIG. 8B) of an RB needle, Neolus, 25G×1 connected to the bubble ejection member 1*b* produced in Example 1 while being pressured by a pump. FIG. 20A is a photograph before the plating solution is supplied, and FIG. 20B is a photograph after the plating solution is supplied. As is apparent from FIG. 20A and FIG. 20B, it was confirmed that, when the bubble ejection member 1*b* having a flow path therein is used, a plating solution can be supplied to the tip part of the bubble ejection member 1*b* via the flow path.

Example 15

[Plating Using Plating Solution Containing Metal Nanoparticle]

Nickel nanoparticles (the average particle diameter: 100 nm, 577995-5G, by Sigma-Aldrich Co. LLC.) were used as metal nanoparticles. Further, a normal saline (by FUJIFILM Wako Pure Chemical Corporation) was used for a solvent. Nickel nanoparticles of 1 g were added to the solvent of 10 g to produce a plating solution of Example 15.

Next, a rubber substrate (8-4053-01, by AS ONE Corporation) was used as a plating target, and plating was performed on the rubber substrate in the following procedure.

(1) A weight was used to stretch the rubber substrate.

(2) The produced plating solution was dripped on the rubber substrate.

(3) The plating apparatus produced in Example 3 was used to eject bubbles while the relative position of the rubber substrate and the bubble ejection port was changed under the electrical output condition of the applied power of 15 W (applied voltage of 1200 V), 40 times, and the pulse width of around 1 μs.

Figure 21:
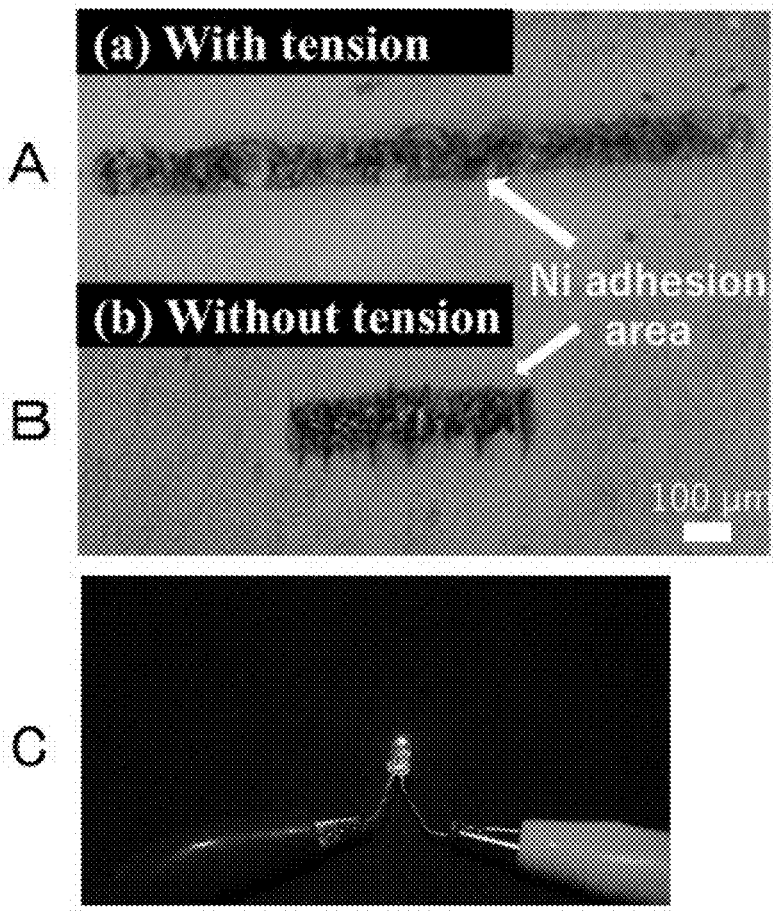
FIG. 21A to FIG. 21C are photographs substitute for drawing.

FIG. 21A is a photograph of the stretched rubber substrate after plated, and FIG. 21B is a photograph of the contracted rubber substrate after the weight was removed. When a stretchable material such as a rubber is used as a plating target, a contact property of a plated metal can be enhanced by stretching and plating the plating target and then restoring the plated plating target to the original state, as illustrated in FIG. 21A and FIG. 21B.

Next, electrical cables are arranged so as to contact with both ends of the plated portion on the rubber substrate restored to the original state as illustrated in FIG. 21B. Next, a power supply and an LED were connected to the arranged electrical cables, and thereby the conductivity capacity of the plated portion was confirmed. FIG. 21C is a photograph indicating a result of the confirmation experiment of the conductivity capacity. As indicated in FIG. 21C, it was confirmed that the LED was turned on and therefore the plated portion on the rubber substrate functions as a circuit. From the result of Example 15, application to a rubber glove with a sensor or the like is expected.

INDUSTRIAL APPLICABILITY

The plating method disclosed in the present specification can plate a predetermined position on various plating targets without implementing a pretreatment thereon. Further, the bubble ejection member and the plating apparatus can be suitably used for the plating method. Further, a novel device can be produced by the plating method disclosed in the present specification. Therefore, the invention is useful in various fields in which plating is required, such as a field of semiconductor manufacturing, a field of information processing, a field of livestock, agriculture, forestry, and fisheries, for example.

LIST OF REFERENCES

1*a*, 1*b* bubble ejection member
2 bubble
3 plating solution
4 plating target
5 plating (metal layer)
6 electrical output mechanism
7 air gap
11 electrode
12 insulating material
13 bubble ejection port
14 flow path
15 reservoir
61 power supply apparatus
62 counter electrode
63 electrical cable
64 noninductive resistor
65 input/output port (Digital Input Output (DIO))
66 control apparatus
111 acute shape (acute portion)

The invention claimed is:

1. A plating method performed on a plating target using a plating solution and a bubble ejection member,
wherein the bubble ejection member includes:
an electrode formed of a conductive material; and
an insulating member covering at least a part of the electrode, and
at least a part of the insulating member forms a bubble ejection port, and an air gap surrounded by the insulating member is formed between at least a part of the electrode and the bubble ejection port,
the plating method comprising at least:
supplying the plating solution to a target portion of the plating target to be plated;
ejecting a bubble generated by the bubble ejection member from the bubble ejection port to the plating solution on the plating target; and
performing plating the target portion of the plating target,
wherein the ejecting the bubble comprises applying a voltage between the electrode and a counter electrode, and
the counter electrode is a member different from the plating target and placed at a location other than the air gap of the bubble ejection member.

2. The plating method according to claim 1,
wherein the plating solution contains metal ions, and
wherein the metal ions in the plating solution are converted into a metal by ejecting the bubble generated by the bubble ejection member to the plating solution.

3. The plating method according to claim 1, wherein the plating solution contains metal nanoparticles.

4. The plating method according to claim 1, wherein in the ejecting the bubble, a recess is formed in the plating target by the ejected bubble, and a metal is formed inside the recess.

5. The plating method according to claim 1, wherein in the ejecting the bubble, a metal is formed on the plating target continuously by ejecting bubbles while changing a relative position of the bubble ejection port and the plating target.

6. The plating method according to claim 1, wherein the bubble ejection member includes a flow path to supply the plating solution to at least a part of the electrode,
wherein the flow path is
formed inside the electrode, and/or
formed by a combination of the electrode and the insulating member.

7. The plating method according to claim 1, wherein at least a part of the electrode has an acute shape.

8. The plating method according to claim 1, wherein the plating target is of a type selected from a metal, a resin, an animal, or a plant.

9. The plating method according to claim 2, wherein the plating solution contains metal nanoparticles.

10. The plating method according to claim 2, wherein in the ejecting the bubble, a recess is formed in the plating target by the ejected bubble, and a metal is formed inside the recess.

11. The plating method according to claim 2, wherein in the ejecting the bubble, a metal is formed on the plating target continuously by ejecting bubbles while changing a relative position of the bubble ejection port and the plating target.

12. The plating method according to claim 2, wherein the bubble ejection member includes a flow path to supply the plating solution to at least a part of the electrode, wherein the flow path is formed inside the electrode, and/or formed by a combination of the electrode and the insulating member.

13. The plating method according to claim 2, wherein at least a part of the electrode has an acute shape.

14. The plating method according to claim 2, wherein the plating target is of a type selected from a metal, a resin, an animal, or a plant.

15. The plating method according to claim 1, wherein the counter electrode is placed in contact with the plating solution.

16. The plating method according to claim 15, wherein the counter electrode is placed in contact with the plating target.

* * * * *